US005921306A

United States Patent [19]

Smederöd

[11] Patent Number: 5,921,306

[45] Date of Patent: Jul. 13, 1999

[54] VENETIAN BLIND OPERATING DRUM

[75] Inventor: Eric Gunnar Magnus Smederöd, Forsnor, Sweden

[73] Assignee: Smederod Trading AB, Goteborg, Sweden

[21] Appl. No.: 07/930,539

[22] Filed: Sep. 24, 1992

[30] Foreign Application Priority Data

Mar. 26, 1990 [SE] Sweden ..... 9001088

[51] Int. Cl.[6] ..... E06B 9/38

[52] U.S. Cl. ..... 160/177 R

[58] Field of Search ..... 160/177 R, 176.1, 160/168.1, 178.1

[56] References Cited

U.S. PATENT DOCUMENTS

| | | | |
|---|---|---|---|
| 2,837,152 | 6/1958 | Moore | 160/176.1 X |
| 3,333,905 | 8/1967 | Hennequin | 160/177 X |
| 4,484,612 | 11/1984 | Vecchiarelli | 160/177 |
| 4,494,593 | 1/1985 | Fielder, Jr. . | |
| 4,821,789 | 4/1989 | Van Rens . | |
| 5,074,349 | 12/1991 | Yannazzone | 160/177 |

FOREIGN PATENT DOCUMENTS

| | | | |
|---|---|---|---|
| 274198 | 9/1966 | Australia | 160/177 |
| 222908 | 10/1968 | Sweden . | |
| 410884 | 11/1979 | Sweden . | |

*Primary Examiner*—David M. Purol
*Attorney, Agent, or Firm*—Dvorak & Orum

[57] ABSTRACT

A ladder cord drum for use in a venetian blind comprising a housing mounted on an actuating or tilting shaft of the blind. The housing is formed having tongues on which ends of side strands of a ladder cord are impaled, whereupon the tongues are locked to the housing.

6 Claims, 1 Drawing Sheet

VENETIAN BLIND OPERATING DRUM

BACKGROUND OF THE INVENTION

The present invention relates to a device in drums designed to operate Venetian blinds of the kind comprising slats supported by ladder cords. The operating drum generally comprises a cylindrical housing having a cavity for reception therein of a blind actuating or tilting shaft. The housing is formed with means for fastening the ladder cord side strands.

Venetian blind operating drums must meet strict operating requirements inasmuch as they must function reliably when one wishes to re-set the blind slat tilting positions to change the amount of light admitted through the blind. Specifically, it must be possible to attach the ends of the ladder cord side strands swiftly and securely to the operating drum.

A number of different constructions of ladder cord drums have appeared in recent years, none of which are entirely satisfactory. In accordance with one construction, a metal tongue is pressed against overlapping ends of ladder cord side strands for fastening the side strands to the drum. This construction, however, has the disadvantage that the fastening of the side strands to the drum is not entirely reliable and that after some time of use, the metal tongue may dislodge itself from the drum. Another disadvantage of existing ladder and drums is that end parts of the ladder cord side strands protrude from the drum, which may be the cause of certain complications.

Attempts have also been made to form an operating drum having slits in which to insert the ends of the ladder cord side strands alone or in combination with fastening pins. This manner of fastening the ladder cord, however, is not entirely satisfactory, since this manner of attachment complicates the fastening operation.

There exists therefore a need for an advancement in the art that overcomes the deficiencies discussed above.

It is an object of the present invention to provide a novel ladder cord operating drum.

It is also an object of the present invention to provide a novel ladder cord operating drum for engaging and retaining a ladder cord.

It is a further object of the present invention to provide a novel ladder cord operating drum having tongues for engaging and retaining a ladder cord.

It is a further embodiment of the present invention to provide a novel ladder cord operating drum for engaging, retaining and protectively receiving a ladder cord end.

These and other objects, features, and advantages of the present invention will become apparent upon consideration of the following detailed description of the invention and the accompanying drawings.

DETAILED DESCRIPTION OF THE DRAWINGS

Figure 1:
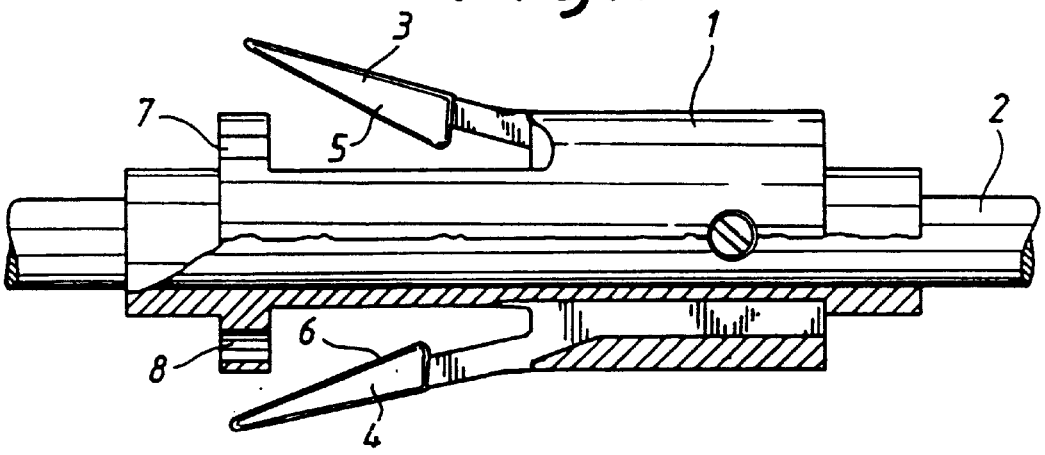
Figure 2:
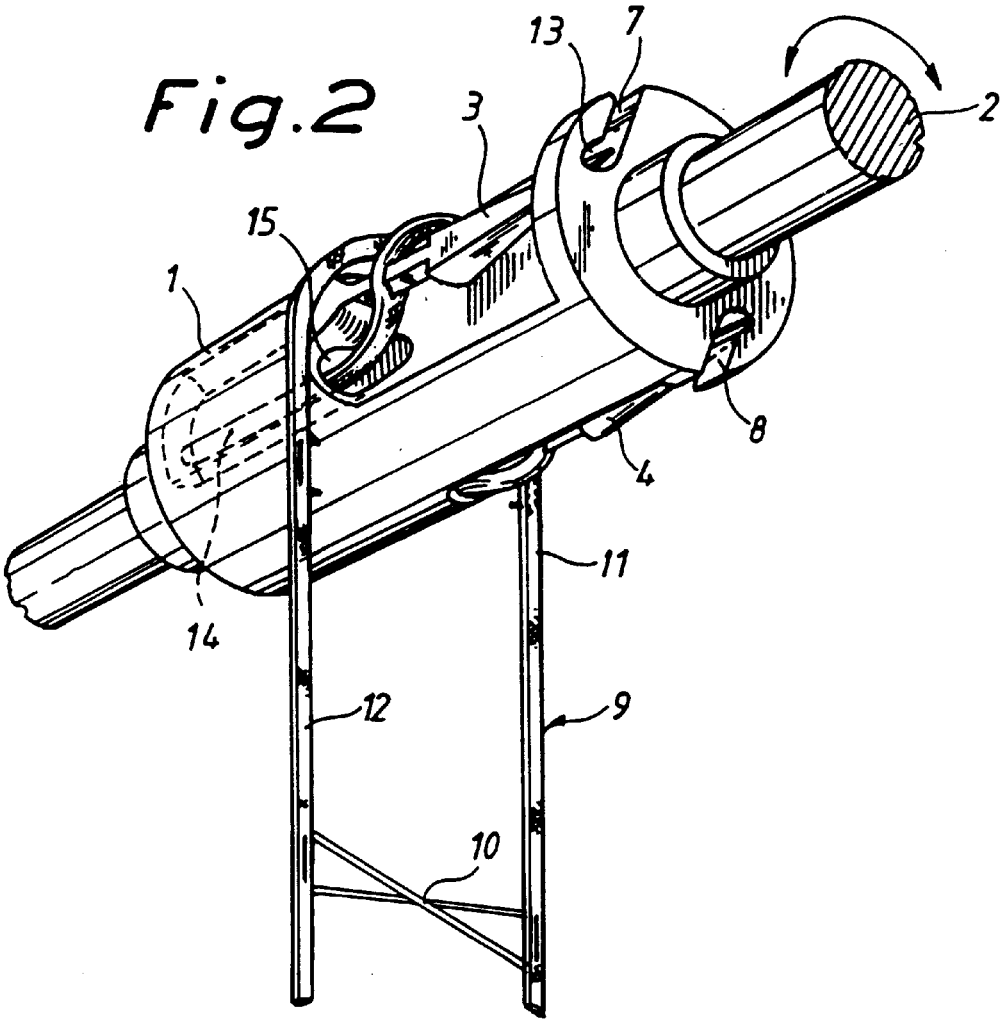

FIG. 1 is a partly sectionalized lateral view through the ladder cord drum in accordance with the invention, and FIG. 2 illustrates the same drum as in FIG. 1 in a perspective view with the ladder cord mounted thereon.

DETAILED DESCRIPTION OF THE INVENTION

The drum illustrated in FIG. 1 comprises a housing 1 which is mounted on a shaft 2. The housing 1 is formed with two tongues 3 and 4 which are positioned one on either side of a diameter passing through the drum and which are equally spaced from that diameter. Each tongue 3 and 4 has one end flexibly joined to the housing 1. The tongues 3 and 4 are preferably mounted integrally with the housing 1. The free tongue ends are shaped like arrow-heads 5, 6 and slits 7 and 8 (see FIG. 2) are formed in the drum 1 in alignment with the arrow-heads for receiving the arrow-heads for the purpose of locking and fastening a cord 9 as discussed below.

The ladder cord 9 is mounted on the drum and fastened thereto in the following manner. At the upper end of the ladder cord 9 a number of cross rungs 10 are removed, whereby end portions having a predetermined free length are obtained in each one of the cord side strands 11, 12. The end of strand 11 is passed over the drum and impaled upon the point of the arrow-head 5 of the tongue 3. The point of the arrow-head 5 is thereafter inserted in the slit 7 sufficiently far to ensure that owing to its inherent resiliency the tongue 3 will spring back into engagement in an interior, enlarged recess 13 formed at the bottom of the slit 7 and be locked in position. The end 14 of the strand 11 is then inserted into a recess 15 formed in the housing 1 wherein it is retained in a protected position. The strand 11 is now locked to the operating drum of the ladder cord 9. The procedure is repeated with regard to the side strand 12 on the other side of the ladder cord 9, although in mirror-image fashion.

When both strands 11, 12 have been fastened to the drum in the manner indicated, the mounting is complete and it should be apparent without detailed explanations, that the ladder cord is secured in position in an extremely efficient manner, despite the very simple arrangement made possible in accordance with the invention.

The invention is not limited to the embodiment as described in the aforegoing and illustrated in the drawings but equivalents and a variety of modifications within the scope of the appending claims do exist. For instance, the tongues may be made from a material different from that of the housing and be attached to the housing in any suitable manner. However, care should be taken to ensure that the tongues are directed in such a manner that they are inserted into the slits 7 and 8 while under tension. In addition, other possibilities of securing the cord ladder strand ends than the one discussed and shown herein are feasible.

I claim:

1. A drum for venetian blinds of the type having a horizontal slat supported by a ladder cord, the ladder cord having a cord side strand with an end portion, the drum comprising:

a cylindrical housing;

a tongue having a first end fixedly disposed on the cylindrical housing and a second free end; and an arrow head disposed on the second free end of the tongue, wherein the cord side strand is impaled by the arrowhead and the cord side strand is fixedly retained by the tongue.

2. The drum of claim 1 further comprising a recess disposed in the cylindrical housing wherein the end portion of the cord side strand may be fixedly disposed in the recess.

3. The drum of claim 1 further comprising means for locking the second end of the tongue to the cylindrical housing.

4. The drum of claim 3 wherein the means for locking the second end of the tongue to the cylindrical housing comprises a flange disposed on the cylindrical housing, the flange having a slit disposed therein, the slit having an enlarged recess wherein the arrowhead may be received by and fixedly retained in the slit thereby locking the second end of the tongue to the cylindrical housing.

5. The drum of claim 1 wherein the tongue is integrally moulded with the cylindrical housing.

6. The drum of claim 4 wherein the tongue is integrally moulded with the cylindrical housing.

* * * * *

UNITED STATES PATENT AND TRADEMARK OFFICE

CERTIFICATE OF CORRECTION

PATENT NO. : 5,921,306

DATED : July 13,1999

INVENTOR(S) : Eric Gunner Magus Smederod

It is certified that error appears in the above-identified patent and that said Letters Patent is hereby corrected as shown below:

On the title page: Item

Cancel "[22] Filed: Sep. 24, 1992" and substitute

-- [22] PCT filed March 20, 1991

[86] PCT No. PCT/SE91/00213

§ 371 Date Sept 24, 1992

§ 102(e) Date Sept 24, 1992

[87] PCT Pub. No.. WO 91/14848 --

PCT Pub. Date: Oct., 3,1991

Signed and Sealed this

Twenty-fifth Day of April, 2000

*Attest:*

Q. TODD DICKINSON

*Attesting Officer*

*Director of Patents and Trademarks*